United States Patent [19]

Sato

[11] Patent Number: 4,635,915

[45] Date of Patent: Jan. 13, 1987

[54] FOLDING CYLINDER FOR A WEB FOLDING APPARATUS

[75] Inventor: Katsumi Sato, Tokyo, Japan

[73] Assignee: Kabushikigaisha Tokyo Kikai Seisakusho, Tokyo, Japan

[21] Appl. No.: 800,389

[22] Filed: Nov. 21, 1985

[30] Foreign Application Priority Data

Apr. 24, 1985 [JP] Japan ..... 60-61266[U]

[51] Int. Cl.[4] ..... B42C 1/04

[52] U.S. Cl. ..... 270/49; 493/427

[58] Field of Search ..... 270/49, 47; 493/425, 493/427, 434

[56] References Cited

U.S. PATENT DOCUMENTS 2,765,164 10/1956 Hand ..... 493/434 X 4,445,881 5/1984 Bullen et al. ..... 493/427 X

FOREIGN PATENT DOCUMENTS 870194 10/1981 U.S.S.R. ..... 493/425

OTHER PUBLICATIONS

"Newspaper Letterpress Presses" ANPA Research Institute, 3rd Edition, 750 Third Avenue, N.Y. 10017, pp. 20, 148–153.

*Primary Examiner*—E. H. Eickholt

*Attorney, Agent, or Firm*—Schwartz, Jeffery, Schwaab, Mack, Blumenthal & Evans

[57] ABSTRACT

A folding cylinder for a folder capable of collect run and straight run is provided with protrusions of a height corresponding to the thickness of an inside section to be folded on the folder. The protrusions are extended or arranged beyond the corresponding cutting knife receiving members adjacently thereto respectively so that portions of the papers on both sides of a cutting line are pressed firmly against the circumference of the folding cylinder and the top surface of the protrusion of protrusions in a state of tension to allow precise cutting.

3 Claims, 20 Drawing Figures

FOLDING CYLINDER FOR A WEB FOLDING APPARATUS

BACKGROUND OF THE INVENTION

1. Field of the Invention

The present invention relates to a folding cylinder and more specifically to a folding cylinder employed in a folder which introduces the webs laid one over another between the folding cylinder and a cutting cylinder which are disposed side by side and rotate in opposite directions to each other, cuts the webs in a section of the printed papers by cutting the webs by bringing the cutting knife in the cutting cylinder into engagement with the knife receiving member in the folding cylinder, and then folds the section of the printed papers. Still more specifically, the present invention relates to a folding cylinder employed in a folder capable of so-called collect run in which an inside section of the printed papers is held temporarily by the pins in the folding cylinder so that the inside section wraps around the circumference of the folding cylinder and waits for an outside section of the printed papers. The outside section of the printed papers is superposed on the inside section of the printed papers and cut after the folding cylinder is rotated by a full turn, and then the superposed sections are folded together.

2. Description of the Prior Art

So-called collect run, in which a folding cylinder and cutting cylinder are disposed side by side, an inside section of the printed papers is wrapped around the folding cylinder and made to wait for an outside section of the printed papers, and the inside section of the printed papers and the outside section of the printed papers are superposed and folded together, has been known. Such a prior art is disclosed, for example, in "Newspaper Leterpress Presses", ANPA Res. Inst., Third edition, First printing, pp. 20, 150–152, 154. A typical known so-called 3:2 folder in which a cutting cylinder turns by half a turn while a folding cylinder turns by one-third of a turn will be described hereunder with reference to FIG. 7 showing part of the folder and FIGS. 8(*a*) to 8(*f*) sequentially showing the operating processes in one-third of a turn of the folding cylinder.

In collecting an outside section 204A of the printed papers each having a printed surface A and an inside section 204B of the printed papers each having a printed surface B in layers and folding sections 204A and 204B together on this conventional folder, the different printed surfaces A and printed surfaces B are printed longitudinally alternately on each web 200, and each web is collected in layers before a former 2 to form the webs 201. The webs 201 are delivered to a former 2 by a drag roller 1 to fold the webs 201 by the former 2. Alternatively the webs 201 are slit longitudinally by a slitter 3 as they pass the drag roller 1, and then the separated parts of the webs are superposed one over the other as shown in FIG. 7.

Then, the webs 201 are delivered between a folding cylinder 4 and a cutting cylinder 5. In a collect run in which the outside section 204A of the printed papers each having a printed surface A is placed outside with respect to the folding cylinder 4, the inside section 204B of the printed papers each having a printed surface B is held by the pins 61 at a portion immediately behind a portion to be the leading end of the inside section 204B as shown in FIG. 8(*a*) and the inside section 204B is pressed against the folding cylinder 4 as the folding cylinder 4 and the cutting cylinder 5 rotate in opposite directions indicated by arrows in FIG. 8(*a*). The inside section 204B of the printed papers is pressed against the folding cylinder 4 by a paper pressing member 81 disposed so as to be brought into contact with a cutting knife receiving member 91 and protruded from the circumference of the cutting cylinder 5 on both sides of a cutting knife 71 by being urged by an elastic member, not shown, engaging the inner end thereof so that the outer end thereof is positioned practically flush with the cutting edge of the cutting knife 71.

When the paper pressing member 81 engages and presses the webs 201, the elastic member urging the paper pressing member 81 radially outward is compressed as the paper pressing member 81 is caused to retract, and then the cutting knife 71 engages the cutting knife receiving member 91 to cut off an end piece 203 (FIG. 8 (*a*)). At this time, the pins 62 are retracted inside the folding cylinder 4 to release the section of the printed paper, which action is similar to the action of the pins 63 in a state shown in FIG. 8(*c*) and that of the pins 61 in a state shown in FIG. 8(*e*).

On the other hand, as shown in FIG. 8(*a*), a folding blade 101 protrudes outside from the folding cylinder 4 in a state shown in FIG. 8(*c*) or in a state shown in FIG. 8(*e*) to insert the section of the printed paper released from the pins 62 (63, 61) between second fold rollers 11.

Then, as the folding cylinder 4 rotates, the webs 201 held by the pins 61 are introduced between the folding cylinder 4 and the cutting cylinder 5, while the same is wrapped around the circumference of the folding cylinder 4. Then, the webs 201 are held at a portion immediately behind a portion to be the leading end of the outside section 204A of the printed papers, each having a printed surface A with the pins 63 and are pressed against the folding cylinder 4 as the folding cylinder 4 and the cutting cylinder 5 rotate as shown in FIG. 8(*b*).

The section 204A is pressed against the folding cylinder 4 with a paper pressing member 82 disposed so as to come into contact with a cutting knife receiving member 93 and protruded from the circumference of the cutting cylinder 5 on both sides of a cutting knife 72 by being urged by an elastic member, not shown, engaging the inner end thereof so that the outer end thereof is positioned practically flush with the cutting edge of the cutting knife 72. The paper pressing member 82 retracts and compresses the elastic member when the same engages the webs 201, and thereby the cutting knife 72 engages the cutting knife receiving member 93 to cut the webs 201 along a line separating the trailing end of the inside section 204B of the printed papers each having a printed surface B and the leading end of the outside section 204A of the printed papers each having a printed surface A (FIG. 8(*b*)). On the other hand, the pins 61 do not retract inside the folding cylinder 4 and keep holding the section as the pins 62 in FIG. 8(*d*) and the pins 63 in FIG. 8(*f*), while the folding blade 102 remains retracted within the folding cylinder 4. Therefore, the section held by the pins 61 (62, 63) remains on the circumference of the folding cylinder 4 and rotates together with the folding cylinder 4.

Thereafter, the cutting cylinder 5 and other members perform the actions shown in FIGS. 8(*c*) and 8(*d*) sequentially at every one-third of a turn of the folding cylinder 4.

In this conventional folder, the cutting cylinder 5 turns by half a turn to cut the webs 201 at every one-third of a turn of the folding cylinder 4. A bracket 109 holding the folding blades 101 and 102 turns by one full turn within the folding cylinder 4 to protrude the folding blade 101 outside the folding cylinder 4 in order to fold the section of the printed paper while the folding cylinder 4 turns by two-thirds of a turn. The pins 61, 62 and 63 are retracted inside the folding cylinder 4 in synchronism with the protrusion of the folding blade 101 outside the folding cylinder 4 after the outside section 204A of the printed papers each having a printed surface A has been superposed on the inside section 204B of the printed papers each having a printed surface B.

Problems to be Solved by the Invention

In the collect run employing the above-mentioned well-known folding cylinder, a problem lies in the cutting operation shown in FIGS. 8(*d*) and 8(*f*) in which the section 204A is superposed on the section 204B which has previously been cut and separated from the webs 201 and is held on the circumference of the folding cylinder 4 and the trailing end of the section 204B and the leading end of the section 204A are formed simultaneously. This problem will be explained in detail with reference to FIGS. 9 and 10. FIG. 9 is an enlarged view corresponding to a portion indicated by X in FIG. 8(*d*) and FIG. 10 is a view similar to FIG. 9, in which a mode of tension of the webs 201 when the cutting cylinder 5 is removed tentatively is shown. In the cutting operation to form the trailing end of the section 204B, the webs 201 for forming the leading end of the section 204A mount the leading portion of the section 204B waiting on the circumference of the folding cylinder 4. Therefore, a portion of the webs 201 around the leading end corresponding to a cutting position is inclined, and gap 19′ is formed between the webs 201 and the circumference of the folding cylinder 4 as shown in FIG. 10. When the cutting knife 72 engages the cutting knife receiving member 91 to cut the webs 201 in such a state, the paper pressing member 82 protruding on both sides of the cutting knife 72 is unable to press the webs 201 firmly with the entire area of the outer end face thereof, because the portion of the webs 201 lying over the cutting position is inclined. Furthermore, the cutting knife 72 is unable to cut the webs 201 along the normal. Consequently, when the cutting knife 72 engages the cutting knife receiving member 91, the papers of the section 204B, particularly the several papers from the top among the papers of the knife 204B lying beyond the cutting position and pressed unstably by the paper pressing member 82 are drawn backward by the cutting knife 72 so that the cutting knife 72 is aligned with the normal. The papers thus drawn backward move further backward following the movement of the cutting knife 72, and the webs 201 are cut while several papers are moving backward (FIG. 9). Consequently, the marginal portion W (FIG. 8(*d*)) beyond the pins of each of the papers drawn backward is torn by the pins 62 and those papers are not held by the pins 62 at the completion of the cutting operation. Accordingly, those papers which are not held by the pins 62 are unable to follow the rotation of the folding cylinder 4 and stay about the circumference of the folding cylinder 4 disturb the folder in its normal operation.

SUMMARY OF THE INVENTION

The present invention has been made to solve those problems in the conventional folder.

Accordingly, it is an object of the present invention to provide a folding cylinder for a folder, provided with protrusions formed on the circumference thereof beyond the corresponding cutting knife receiving members with respect to the direction of rotation thereof and capable of allowing a web to extend in a uniform circular arc on both sides of a cutting position on the circumference thereof so that the webs are pressed firmly against the circumference thereof.

According to the present invention, in collect run, the succeeding webs mount the inside section of the printed paper wrapped around the folding cylinder and waiting for superposition with a portion thereof extending beyond a cutting position mounting the protrusion or protrusions. Hence the portion extending beyond the cutting position and a portion extending behind the cutting position are the same in height from the circumference of the folding cylinder, whereby both the portions of the webs are pressed firmly against the folding cylinder at the cutting position.

The above and other objects, features and advantages of the present invention will become apparent from the following description taken in connection with the accompanying drawings wherein preferred embodiment thereof are illustrated by way of example.

DESCRIPTION OF THE PREFERRED EMBODIMENTS

Figure 1:
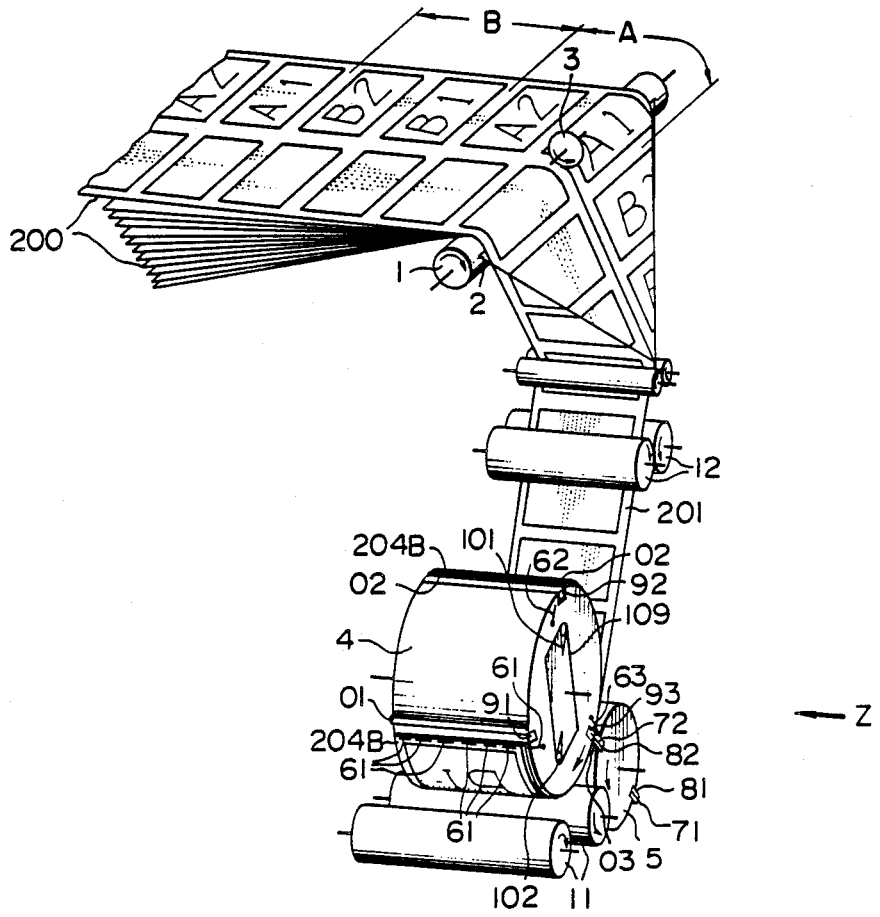
FIG. 1 is a fragmentary perspective view of a folder employing a folding cylinder according to the present invention.
Figure 2A:
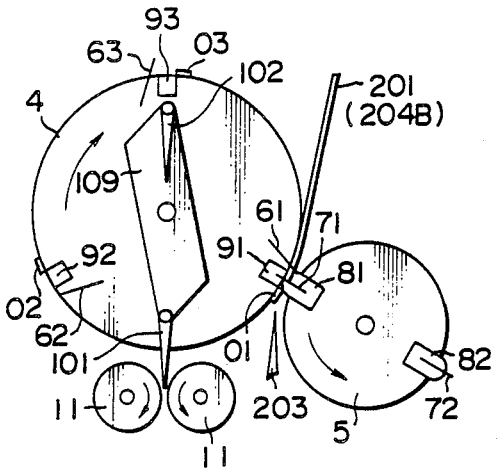
FIGS. 2(*a*) to 2(*f*) are schematic side elevations of the folding cylinder and the associated components of the folder of FIG. 1 taken along an arrow Z, showing the steps of collect run.
Figure 2B:
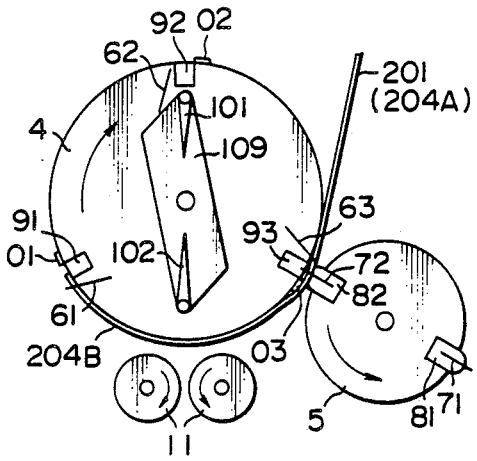
Figure 2C:
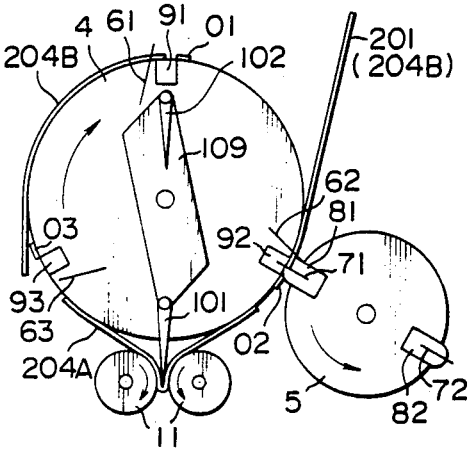
Figure 2D:
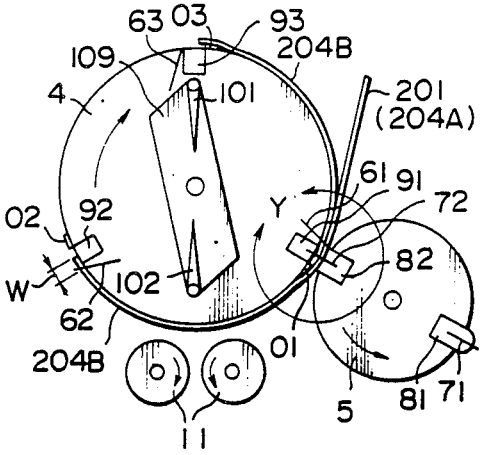
Figure 2E:
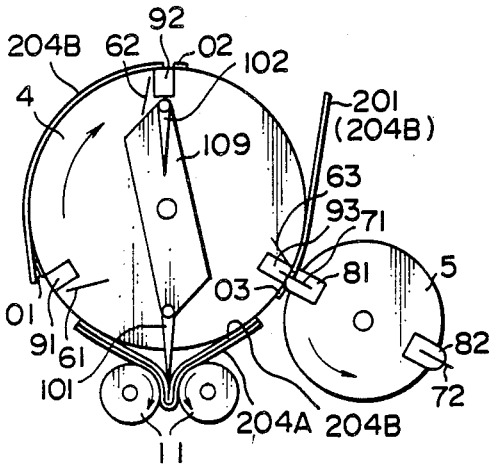
Figure 2F:
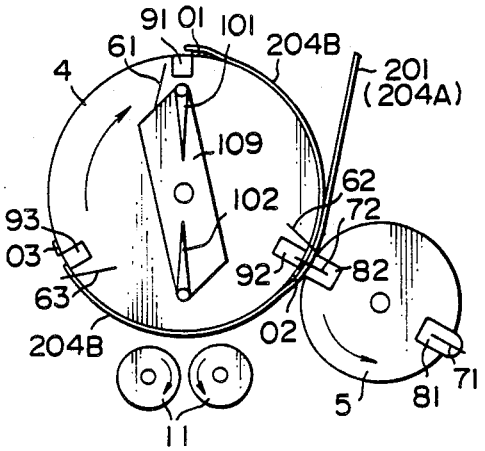
Figure 3:
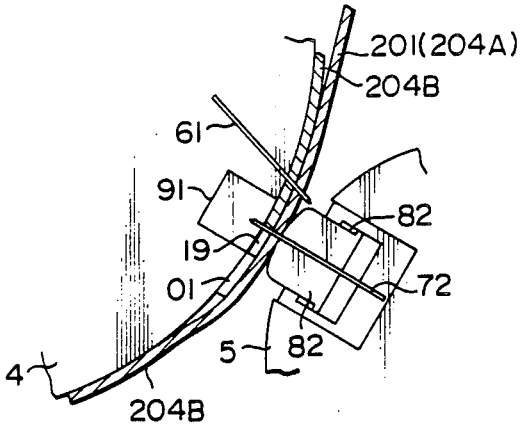
FIG. 3 is a schematic enlarged fragmentary view showing part of a portion of FIG. 2(*d*) indicated by a symbol Y.
Figure 4:
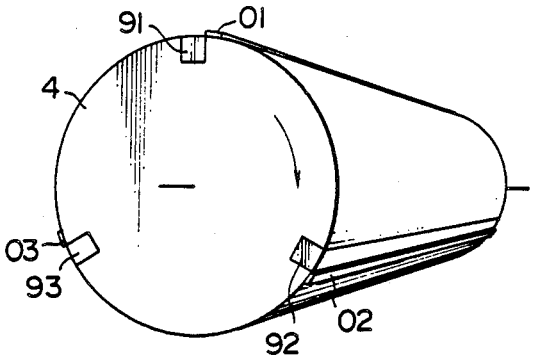
FIGS. 4 and 5 are perspective views of preferred embodiments of the present invention respectively.
Figure 5:
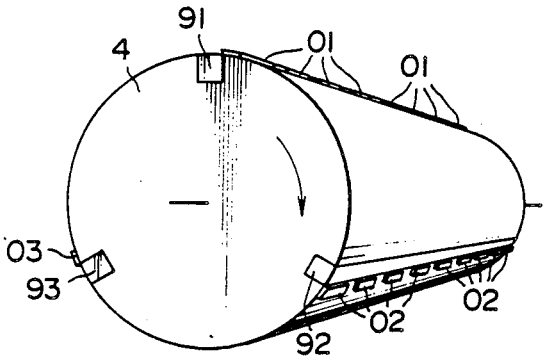

The present invention will be described hereinafter with reference to preferred embodiments thereof in connection with FIG. 1 showing a folder employing a folding cylinder of the present invention FIG. 2(*a*) to 2(*f*) showing the steps of collect run of the folder of FIG. 1, FIG. 3 showing a portion of FIG. 2(*d*) indicated by a symbol Y in an enlarged view, FIG. 4 showing a first embodiment of the present invention in a perspective view, and FIG. 5 showing a second embodiment of the present invention in a perspective view.

In the drawings, there are shown a drag roller 1, a former 2, a slitter 3, a folding cylinder 4, a cutting cylinder 5, pins 61, 62 and 63, cutting knives 71 and 72 provided on the cutting cylinder 5, paper pressing members 81 and 82 provided also on the cutting cylinder 5, cutting knife receiving members 91, 92 and 93 provided on the folding cylinder 4, folding blades 101 and 102 provided also on the folding cylinder 4, second fold rollers 11 disposed adjacent to and beyond the folding cylinder 4 with respect to the running direction of a web, nipping rollers 12, each web 200 having different printed surfaces A and B arranged alternately along the longitudinal direction thereof, protrusions 01, 02, 03 arranged on the circumference of the folding cylinder 4 adjacently to and beyond the cutting knife receiving members 91, 92, and 93, respectively, and parallel to the longitudinal axis of the folding cylinder 4. The height of the protrusions 01, 02 and 03 desirably is the same as the thickness of an inside section 204B wrapped around the folding cylinder 4.

The folding cylinder 4 and the cutting cylinder 5 are disposed side by side with the longitudinal axis thereof extending in parallel to each other.

A folder incorporating the folding cylinder 4 of the present invention is a so-called 3:2 folder, in which the cutting cylinder 5 turns by half a turn to cut the webs 201 at every one-third a turn of the folding cylinder 4. A bracket 109 holding folding blades 101 and 102 turns by a full turn within the folding cylinder 4 to project the folding blade 101 or 102 from the folding cylinder 4 in order to fold a section or sections of the printed papers at every two-thirds of a turn of the folding cylinder 4. The pins 61, 62 and 63 are retracted inside the folding cylinder 4 in synchronism with the projection of the folding blade 101 (102) from the folding cylinder 4 after the outside section 204A of the printed papers, each having a printed surface A, has been superposed on the inside section 204B of the printed papers each having a printed surface B. The protrusions 01, 02 and 03 provided on the circumference of the folding cylinder 4 each need not necessarily be an elongate member having a top surface having a form of a circular arc and extending in parallel to the longitudinal axis of the folding cylinder 4 as shown in FIG. 4, but may be individual block members arranged separately in a line parallel to the longitudinal axis of the folding cylinder 4. The individual block members may be of any form as long as they are the same in height.

As shown in FIG. 1, each web 200 is placed one over another before the former 2 to form the webs 201. The drag roller 1 introduces the webs 201 into the former 2. The webs 201 are slit longitudinally into two parts as it passes the drag roller 1 and the two parts are placed one over the other as they pass the former 2 as shown in FIG. 1. The webs 201 may be folded by the former 2 instead of being slit.

Then, the webs 201 are introduced into the gap between the folding cylinder 4 and the cutting cylinder 5. In the case of collect run in which sections of the printed papers are placed one over the other with an outside section 204A of the printed papers each having a printed surface A on the outside with respect to the folding cylinder 4, an inside section 204B of the printed papers each having a printed surface B is held at a portion immediately behind the leading end thereof by the pins 61, and the inside section 204B is pressed against the folding cylinder 4 as the folding cylinder 4 and the cutting cylinder 5 rotate in opposite directions as shown in FIG. 2(*a*). The inside section 204B is pressed against the folding cylinder 4 with a paper pressing member 81 disposed so as to come into contact with the cutting knife receiving member 91 and protruded from the circumference of the cutting cylinder 5 on both sides of the cutting knife 71 by being urged by an elastic member, not shown, engaging the inner end thereof so that the outer end thereof is positioned practically flush with the cutting edge of the cutting knife 71.

The paper pressing member 81 retracts and compresses the elastic member when the same engages the webs 201, and thereby the cutting knife 71 engages the cutting knife receiving member 91 to cut off an end piece 203 as shown in FIG. 2(*a*). At this time, the pins 62 retract inside the folding cylinder 4 to release a section therefrom as the pins 63 and 61 do in the state of FIGS. 2(*c*) and 2(*e*), respectively.

On the other hand, as shown in FIG. 2(*a*), the folding blade 101 is projected outside the folding cylinder 4 to insert the section released from the pins 62 between the second fold rollers 11 as in FIGS. 2(*c*) and 2(*e*).

The webs 201 held by the pins 61 are introduced continuously into the gap between the folding cylinder 4 and the cutting cylinder 5 and is wrapped around the circumference of the folding cylinder. Then the outside section 204A of the printed papers, each having a printed surface A, is held at a portion immediately behind a portion to be the leading end thereof by the pins 63 and the outside section 204A is pressed against the folding cylinder 4 as the folding cylinder 4 and the cutting cylinder 5 rotate as shown in FIG. 2(*b*).

The outside section 204A is pressed against the folding cylinder 4 with a paper pressing member 82 disposed so as to come into contact with the cutting knife receiving member 93 and protruded from the circumference of the cutting cylinder 5 on both sides of the cutting knife 72 by being urged by an elastic member, not shown, engaging the inner end thereof so that the outer end thereof is positioned practically flush with the cutting edge of the cutting knife 72. The paper pressing member 82 retracts and compresses the elastic member when the same engages the webs 201, and thereby the cutting knife 72 engages the cutting knife receiving member 93 to cut the webs 201 along a cutting line separating the trailing end of the inside section 204B of the printed papers each having a printed surface A and the leading end of the outside section 204A of the printed papers having a printed surface A (FIG. 2(*b*)). At this time, the pins 61 do not retract inside the folding cylinder 4 and keep holding the section as the pins 62 and 63 do in the state of FIGS. 2(*d*) and 2(*f*), respectively, while the folding blade 102 remains inside the folding cylinder 4. Accordingly, the section held by the pins 61 (62, 63) remains on the circumference of the folding cylinder 4 and rotates together with the folding cylinder 4.

The state shown in FIG. 2(*b*) changes into a state shown in FIG. 2(*c*) after the folding cylinder 4 has turned further by one-third of a turn from the position shown in FIG. 2(*b*).

From this state, the webs 201 held at a portion immediately behind a portion corresponding the leading end of an inside section 204B of the printed papers each having a printed surface B by the pins 62 are introduced successively into the gap between the folding cylinder 4 and the cutting cylinder 5 as the folding cylinder 4 rotates, and then an outside section 204A of the printed papers each having a printed surface A is held at a portion immediately behind a portion corresponding to the leading end thereof by the pins 61 and the same portion is pressed against the folding cylinder 4 with the paper pressing member 82 as the folding cylinder 4 and the cutting cylinder 5 rotate. The paper pressing member 82 retracts and compresses the elastic member pressing the webs 201 and the cutting knife 72 engages the cutting knife receiving member 91 to cut the webs 201 along a cutting line separating the trailing end of the inside section 204B and the leading end of the outside section 204A (FIG. 2(*d*)).

As shown by an enlarged view in FIG. 3, in the state of FIG. 2(*d*), a portion of the webs 201 extending behind the cutting position mounts on the inside section 204B of the printed papers each having a printed surface B which has been waiting on the circumference of the folding cylinder 4, while a portion of the webs 201 extending beyond the cutting position mounts on the protrusion 01 provided on the circumference of the folding cylinder 4 adjacently to the cutting knife receiving member 91. Accordingly, when the webs 201 are pressed against the folding cylinder 4 with the paper pressing member 82 protruding on both sides of the cutting knife 72, the portion extending beyond the cutting position and the portion extending behind the cutting position are practically the same in height, and hence the webs 201 is pressed firmly against the folding cylinder 4 on both sides thereof with respect to the cutting position and is held tight so as to extend practically perpendicularly to the cutting direction, namely, the direction of cutting movement of the cutting knife 72. Consequently, the cutting knife 72 is able to engage the cutting knife receiving member 91 without any hindrance regardless of the existence of a gap 19 between the backside of the webs 201 and the circumference of the folding cylinder 4.

Figure 6:
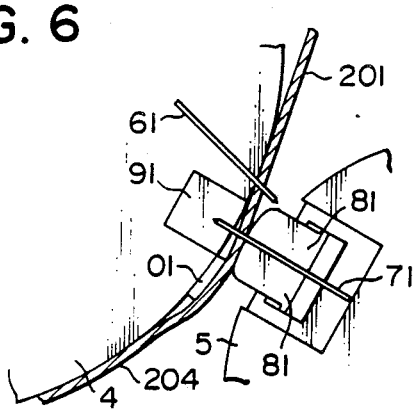
FIG. 6 is a schematic enlarged fragmentary view of the embodiment of FIG. 4 showing the cutting position and its vicinities during straight run.
Figure 7:
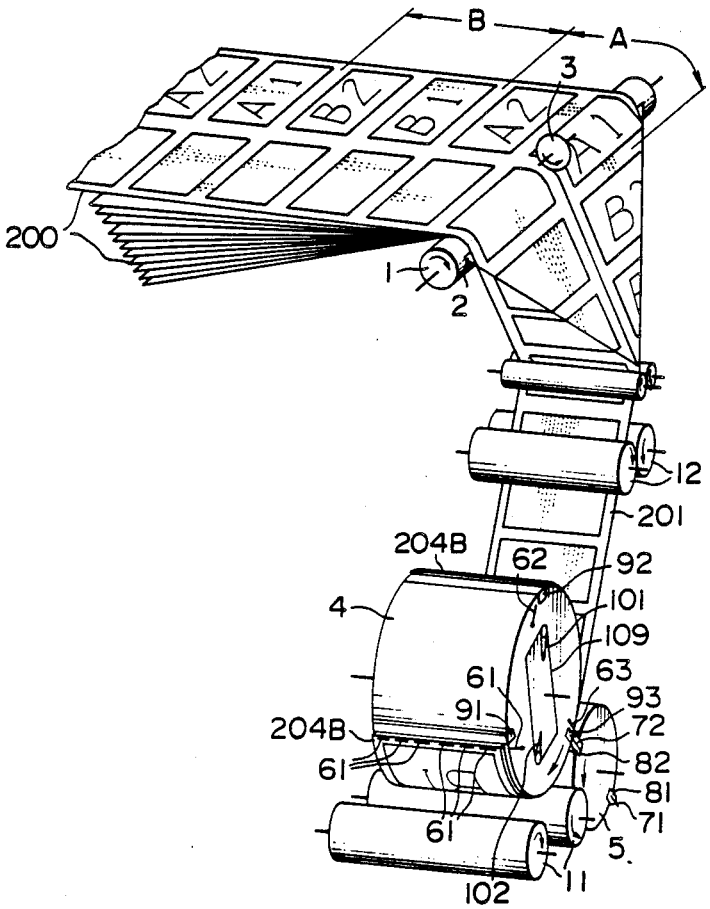
FIG. 7 is a perspective view of a conventional folder.
Figure 8A:
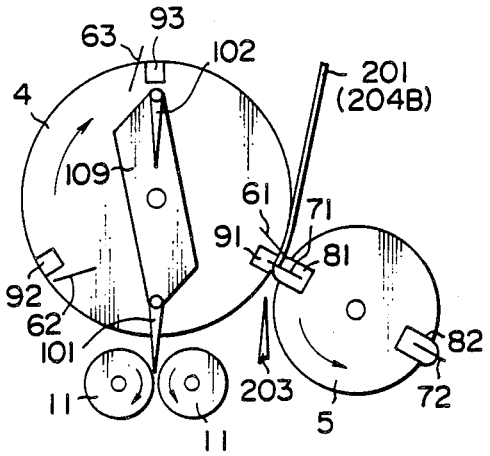
FIGS. 8(*a*) to 8(*f*) are schematic side elevations of the folding cylinder and the associated components of the folder of FIG. 7 showing the steps of folding operation at every one-third of a turn of the folding cylinder.
Figure 8B:
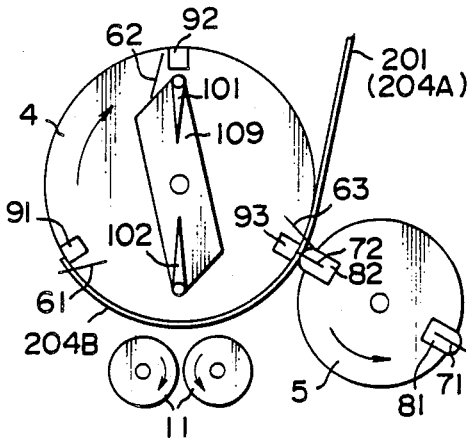
Figure 8C:
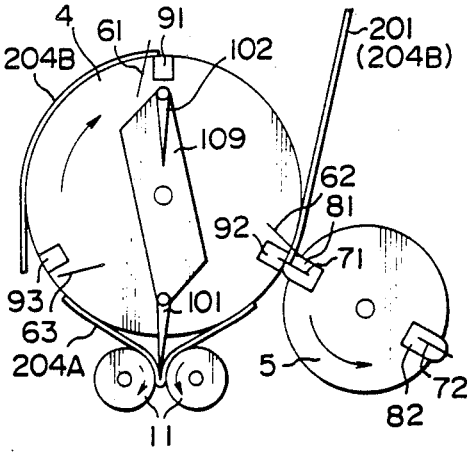
Figure 8D:
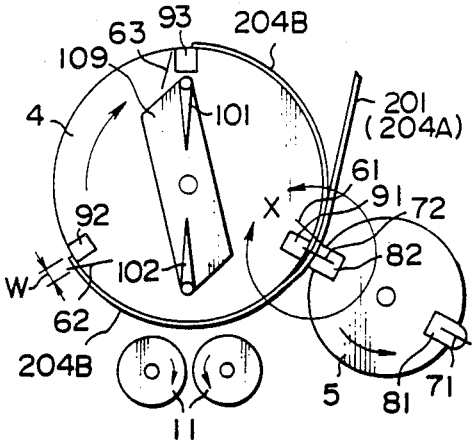
Figure 8E:
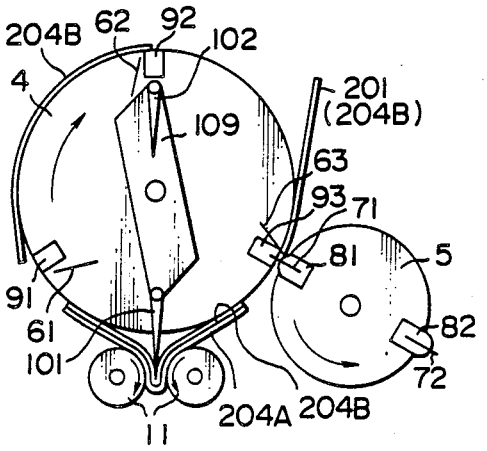
Figure 8F:
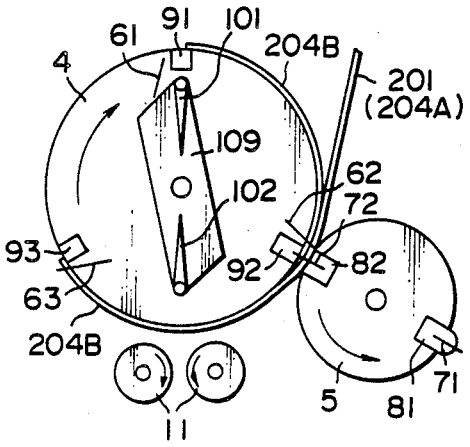
Figure 9:
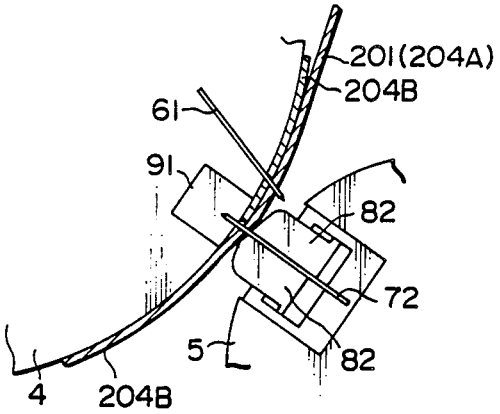
FIG. 9 is a schematic enlarged fragmentary view showing part of a portion of FIG. 8(*d*) indicated by a symbol X.
Figure 10:
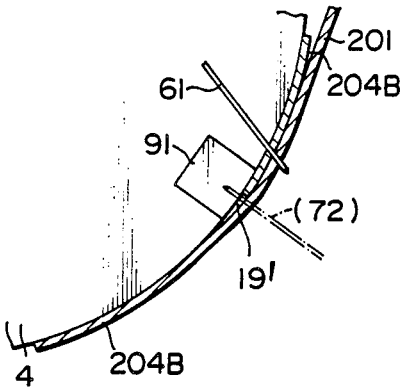
FIG. 10 is a view similar to FIG. 9, showing the tension of the web, in which the cutting cylinder is removed tentatively.

In carrying out straight run by the folder employing the folding cylinder of the present invention, in which every time the webs 201 are cut on the folder, the folding blade 101 or 102 is projected from the folding cylinder 4, while the pins 61, 62 or 63 are retracted in synchronism with the projecting motion of the folding blade 101 or 102 to fold the sections of the printed papers, the webs 201 are wrapped around the circumference of the folding cylinder 4 in a mode of tension as shown in FIG. 6 due to the action of the protrusions 01, 02 and 03 disposed on the circumference of the folding cylinder 4. In this case, the paper pressing members 81 and 82 protruding on both sides of the cutting knives 71 and 72, respectively are unable to press firmly a portion of the webs 201 extending immediately behind the cutting position, however, it does not occur that several papers from the top papers of the webs 201 are drawn and loosened when the webs 201 are cut causing problem, because the webs 201 are held firmly at an upstream position thereof behind the cutting position with the nipping rollers 12.

Thus, according to the present invention, the webs introduced into the gap between the folding cylinder and the cutting cylinder are held firmly with the paper pressing member protruding on both sides of the corresponding cutting knife, particularly at a portion beyond the cutting position. Therefore, even in so-called collect run, the papers extending beyond the cutting position will never be drawn backward and thereby the webs can be cut precisely, and hence a fold of high commercial quality is obtained. Furthermore, the present invention prevents the marginal portion of the inside section to be held by the pins being torn by the pins, and hence the undesirable stagnation of floating section about the circumference of the folding cylinder is prevented and the productivity and the efficiency of the folder are improved.

What is claimed is:

1. A folding cylinder for a web folding apparatus comprising:

(a) a folding cylinder, (b) a cutting cylinder, (c) said cylinders rotating in opposite directions relative to each other for receiving a plurality of superposed webs fed between the folding cylinder and the cutting cylinder, (d) cutting knife receiving members on the folding cylinder, (e) corresponding cutting knives on the cutting cylinder, (f) paper pressing members positioned on opposite sides of the cutting knives, (g) protrusion means disposed on the circumference of the folding cylinder adjacent to and in advance of the cutting knife receiving members with respect to the direction of rotation thereof, for holding the superposed webs introduced between the folding cylinder and the cutting cylinder, in cooperation with the corresponding paper pressing members provided on the opposite sides of the cutting knives in severing the superposed webs.

2. A folding cylinder as recited in claim 1, wherein said folding cylinder has a longitudinal axis and each of said protrusion means is a continuous protrusion extending in parallel to the longitudinal axis of the folding cylinder.

3. A folding cylinder as recited in claim 1, wherein said folding cylinder has a longitudinal axis and each of said protrusion means comprises a plurality of separate blocks disposed at intervals along a line parallel to the longitudinal axis of the folding cylinder.

* * * * *